United States Patent [19]

Dickinson et al.

[11] Patent Number: 4,693,327

[45] Date of Patent: Sep. 15, 1987

[54] MECHANICALLY ACTUATED WHIPSTOCK ASSEMBLY

[75] Inventors: Robert W. Dickinson, 40 Maplewood Dr., San Rafael, Calif. 94901; Charles S. Mackey, Kern County; Irving L. Odgers, Placer County, both of Calif.

[73] Assignees: Ben Wade Oaks Dickinson; Robert W. Dickinson, both of San Francisco, Calif.

[21] Appl. No.: 811,571

[22] Filed: Dec. 23, 1985

[51] Int. Cl.[4] ..... E21B 7/08

[52] U.S. Cl. ..... 175/61; 166/117.6; 175/73

[58] Field of Search ..... 166/117.5, 117.6; 175/61, 62, 65, 67, 70, 73, 75, 80, 321, 422

[56] References Cited

U.S. PATENT DOCUMENTS 1,367,042 2/1921 Granville ..... 175/62
3,640,344 2/1972 Brandon ..... 175/67

FOREIGN PATENT DOCUMENTS 1089224 4/1985 U.S.S.R. ..... 166/117.6

*Primary Examiner*—Stephen J. Novosad
*Assistant Examiner*—William P. Neuder
*Attorney, Agent, or Firm*—Flehr, Hohbach, Test, Albritton & Herbert

[57] ABSTRACT

Structure is passed into an earth well including a whipstock attached to piping and a retractible anchor. The whipstock includes a number of connected guide assemblies. Erection means is connected at one end to a forward guide assembly and at the other end to an extension projecting to the earth surface. To erect the whipstock, an extension of the erection means is pulled from the surface to cause the guide assemblies to swing into a curved pathway. Thereafter, a drilling tube is passed through the whipstock into the adjacent formation. The whipstock may be deerected by releasing the extension means. Then, the anchor is released and the structure is pulled out of the well.

14 Claims, 4 Drawing Figures

MECHANICALLY ACTUATED WHIPSTOCK ASSEMBLY

BACKGROUND OF THE INVENTION

This invention relates generally to earth well drilling apparatus and and its use. Particularly, it relates to apparatus that is useful for drilling one or more bore holes extending laterally from a lower region of a well into a mineral bearing formation.

It has been recognized that minerals may be recovered from mineral-bearing formations by introducing such agents as steam, hot water, chemical solutions and the like. For example steam has been introduced into petroleum-bearing sands (e.g. tar sands or heavy oil) and other porous formations to effect the release and removal of petroleum not otherwise having sufficient fluidity to permit pumping from the well. Certain of such equipment and methods employ special drilling apparatus for drilling a laterally extending bore from a region of the well at the level of the formation, after which steam or other treating fluid is introduced into the bore. An example of such drilling apparatus is disclosed in U.S. Pat. Nos. 2,258,001 and 1,865,853. Such prior drilling equipment and methods have been subject to certain disadvantages. In instances where drilling the lateral bore has employed a rotated cutting head which is directed laterally against the formation, the torque may be applied to the head through driving means extending from the top of the well, which requires complicated and expensive means to transmit power through a vertically rotated pipe or shaft to the laterally directed drillhead. If an electrical driving motor is located within the well and coupled to the drillhead, it poses problems in applying the necessary electrical energy and the motor may not be readily salvageable before injecting steam or other treatment fluid. Use of laterally directed jet drilling as shwon in U.S. Pat. No. 2,258,001 requires special flexible piping which carries the drillhead and to which hydraulic liquid under pressure is applied. Among other objections, flexible conduits are not self-supporting when projected laterally and thus require additional supporting means such as a surrounding housing as shown in U.S. Pat. No. 2,258,001.

EPA Publication No. 0 100 230 discloses an apparatus and method making use of hydraulic jet drilling with the drillhead being attached to a drilling tube of the solid wall type. The drilling tube initially is carried within piping extending downwardly into the well and has an open upper end. A seal is provided between the drilling tube and the piping, whereby when hydraulic liquid (e.g. water) under pressure is applied to the piping, it is propelled downwardly. Tube bending means is carried at the lower end of the piping adjacent the mineral bearing formation, and forms an arcuate guide way through which the drilling tube is propelled, thereby causing the drilling pipe to be bent and the drilling head projected laterally into the formation.

The EPA Publication No. 0 100 230 also discloses a retractable whipstock consisting of connected assemblies, which when extended from a retracted position within the structure form an arcuate tube bending guideway. The assemblies have a series of rollers or sheaves rotatably carried to form a segment of the arcuate guideway. The form of the guideway is generally that of an arc of a circle extending to one side only of the apparatus. The segments are formed into the arcuate pathway by applying hydraulic forces from the surface to a hydraulic piston assembly.

Jeter U.S. Pat. No. 4,007,797, purportedly discloses, in FIG. 10 an erectable whipstock (conductor) which projects to both sides of the assembly in which it is contained prior to erection. An attempt to use the Jeter erectable conductor would result in a number of major problems.

One problem with the conductor of Jeter is that the guide, being flexible, and being held by a single actuating rod (80), is incapable of resisting moments required to bend a solid tube. A further problem with Jeter is the use of a piston which acts axially with respect to the drill pipe. Therefore, actuating rod 80 must be relatively short and at a sharp angle to the axis resulting in high stress on rod 80 to bend the rigid pipe. Furthermore, arm 80 is illustrated on the left (top) side of the conductor in FIG. 8 in an unerected position and of the bottom side in FIG. 9. Obviously, this is a paper not real, solution to the erection problem.

Another problem with Jeter is that it includes no rollers or sheaves to engage the inner or outer walls of the bent tube to reduce frictional forces which can otherwise either prevent the tube from bending through the whipstock or cause the tube to buckle in the whipstock. Perhaps recognizing this, Jeter suggests column 10, line 44–52 that the pipe be flattened as it moves through the whipstock and is thereafter reformed into a circular shape. Rigid pipe is not likely to be capable of such drastic changes in shape on moving through the whipstock.

SUMMARY OF THE INVENTION AND OBJECTS

The present invention is directed primarily to a system for the formation of a bore hole for use in the recovery or enhancement of recovery of oil from an oil-bearing formation, or for the recovrey of mineral deposits or the like, or for drilling through an underground formation for some other purpose. Specifically, the system relates to structure including a number of collapsed connected guideway assemblies fitting within the well bore. The structure also includes a retractable anchor means connected to the rear side of the guideway assembly and erection means also slidable in the assembly. The erection means is pivotally connected to a forward one of the guideway assemblies and the other end to an extension member extending to the earth surface. When the system reaches the desired position adjacent the formation, the anchor means is locked into the earth well and the erection means is pulled by an extension arm from the surface to cause a forward one of the guideway assemblies to be pivotally swung so that the guideway assemblies in composite form a curved pathway extending into the formation. Within the pathway are a series of sheaves or rollers. In the preferred embodiment, the pathway is in an inverted comma shape with portions extending to both sides of the assembly.

After erection, a drilling tube is passed through the whipstock into the formation and is used for steam injection. The tube is cut near the whipstock exit for production and the portion of the tube in the whipstock is pulled back from the surface. The present system also includes a deerection system whereby the extension arm is again lowered to cause the guideway assemblies to move back into their retracted position, the anchor means is collapsed, and the entire assembly can be moved to another position within the well or pulled to the surface. It is an object of the invention to provide whipstock means which can be lowered into an earth well in a collapsed position and extended at the desired depth using mechanical forces.

It is another object of the invention to provide a system for erecting a whipstock with precision with the desired pathway into the formation by applying pulling forces at the surface.

It is another object of the invention to provide a system of the foregoing type capable of deerection by mechanical forces.

It is another object of the invention to provide a system of the foregoing type which is capable of forming a whipstock in an inverted comma shape to both sides of the whipstock to decrease the amount of underreaming required.

Additional objects and features of the invention will appear from the following description in which preferred embodiments have been set forth in detail in conjunction with the accompanying drawings.

DETAILED DESCRIPTION OF THE PREFERRED EMBODIMENTS

Figure 1:
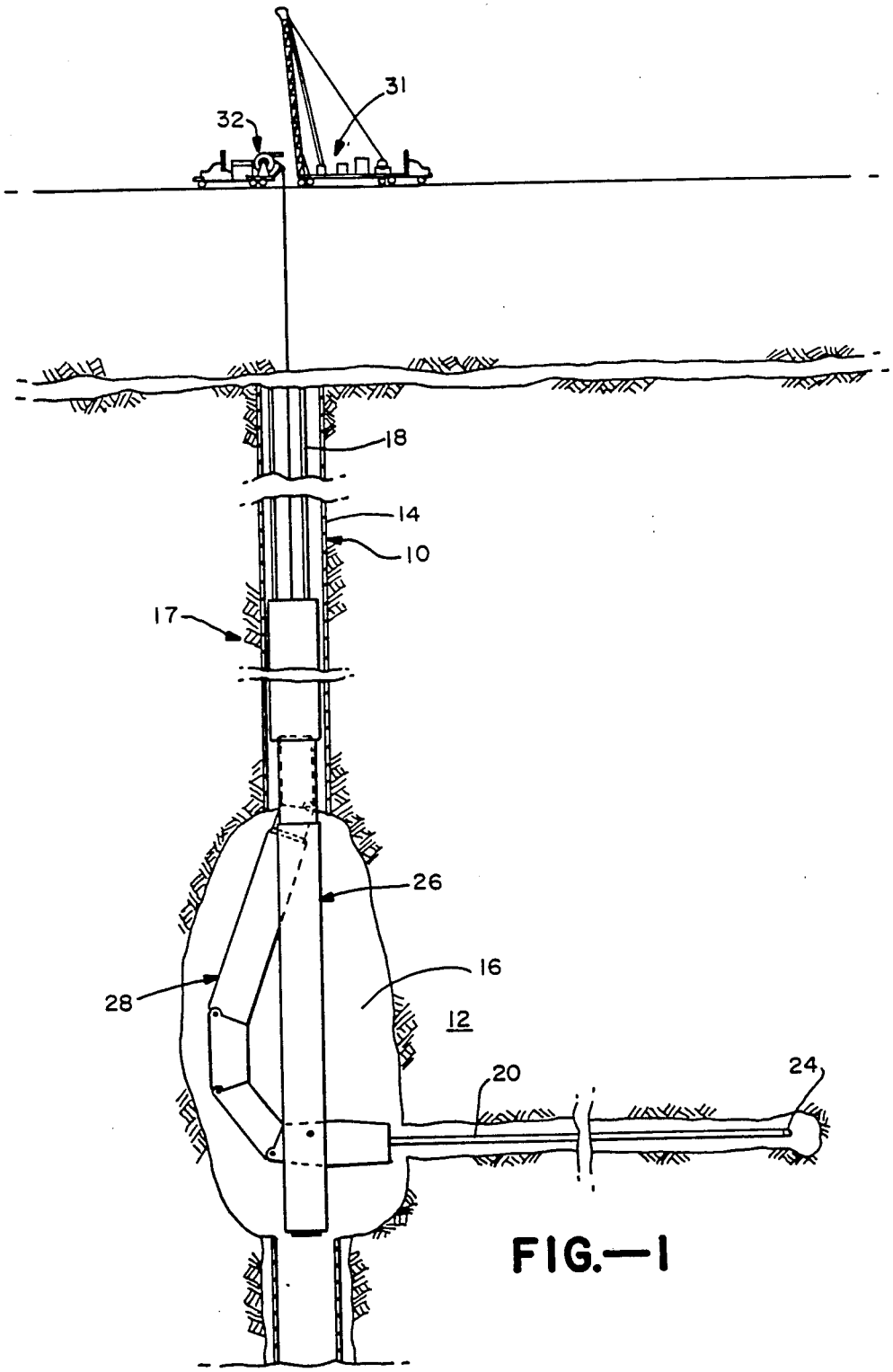
FIG. 1 is a schematic view in side elevation illustrating the apparatus disposed within earth well with the drilling tube extended in a lateral hole.
Figure 4:
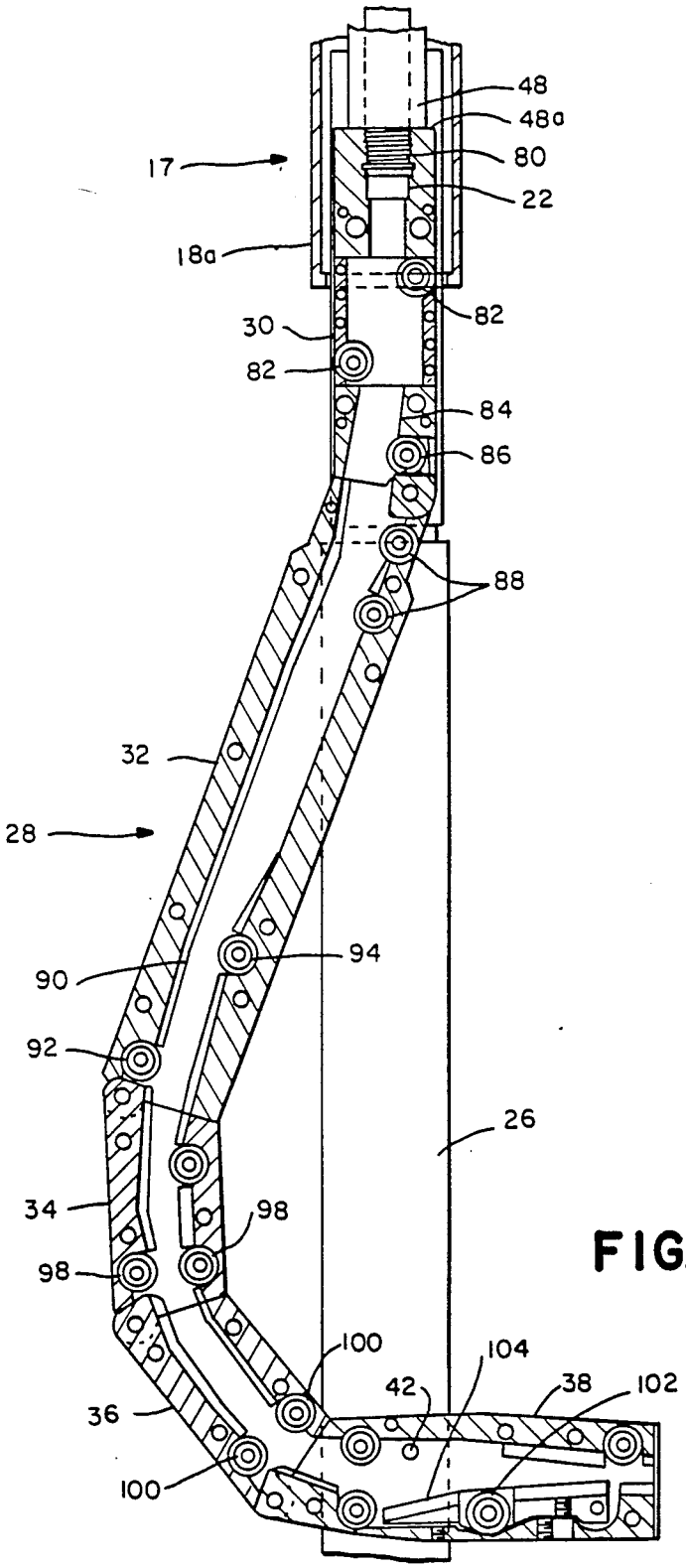
FIG. 4 is a detailed sectional view of the whipstock portion of the device illustrating the interior bending surfaces and wheels.

FIG. 1 schematically shows an earth well 10 which extends down to the mineral bearing formation 12. In this instance, the well is shown provided with a casing 14 which may extend down to an underreamed cavity 16 that is adjacent to the formation 12. Structure 17 includes piping extending in the well consisting, in this instance, of outer piping 18 in the form of a pipe string with a lowermost section 18a shown in FIG. 2, within which a drilling tube 20 is normally disposed. As shown in FIG. 4, a seal 22 is mounted within the pipe string and forms a seal between the pipe string and drilling tube 20. The upper end of the drill pipe is above seal 22 when the drilling tube is retracted. Before the drilling tube is extended, it is within pipe string 18 with its drilling head 24 located below seal 22. Structure 17 also includes housing 26 serving to carry whipstock means 28. Seal 22 is preferably incorporated into the coupling adjacent the upper end of whipstock means 28. Alternatively, it may be disposed in some other portion of outer piping 18. FIG. 1 also schematically shows a production rig 30 of the mobile type and a reel carrying truck 32 which may carry a supply of drilling tube 20, which brings supply drilling tube for use in the well but is not connected during placement of the drilling tube.

Figure 2:
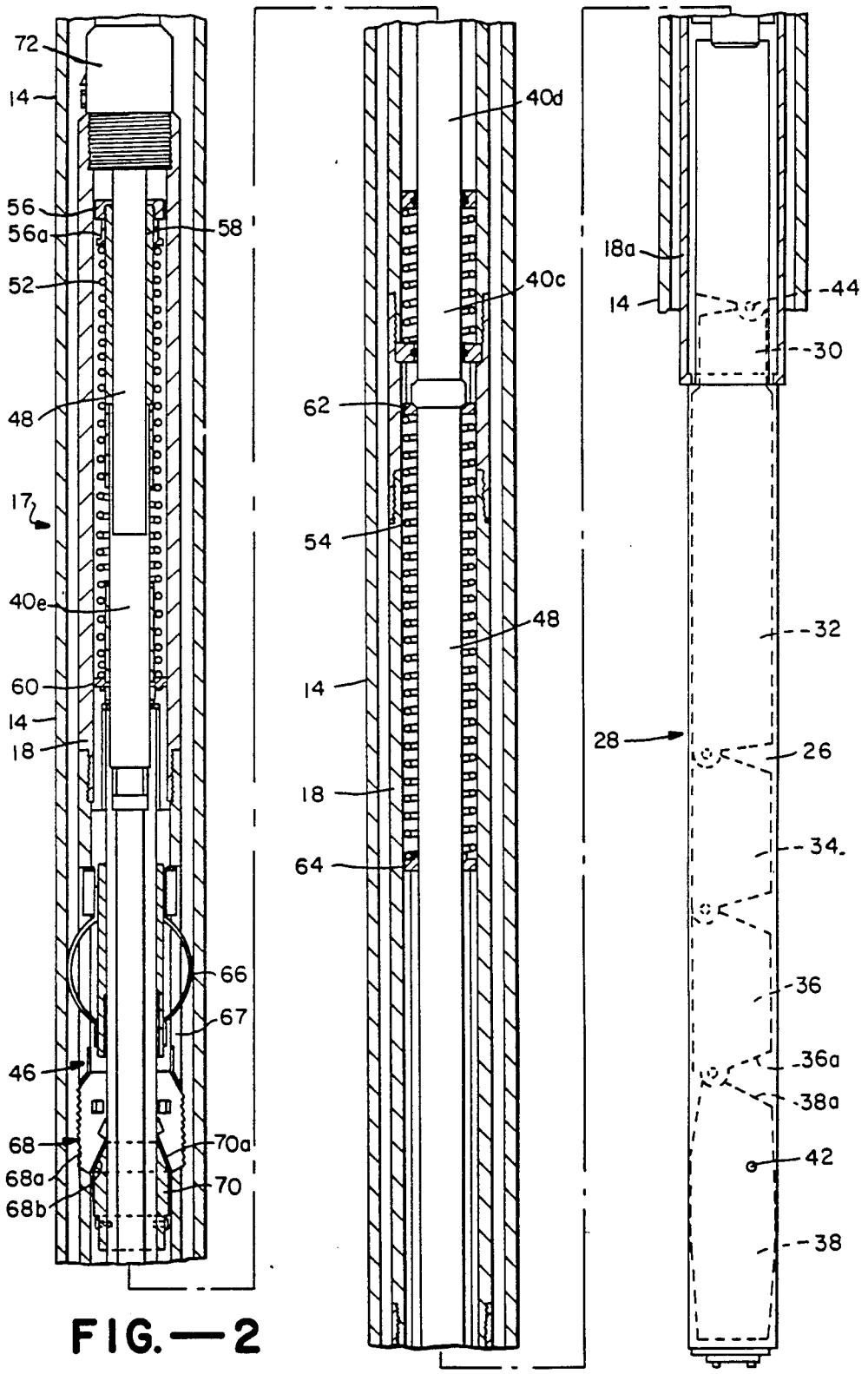
FIG. 2 is a detailed view in side elevation illustrating the whipstock in a collapsed position within its mounting.
Figure 3:
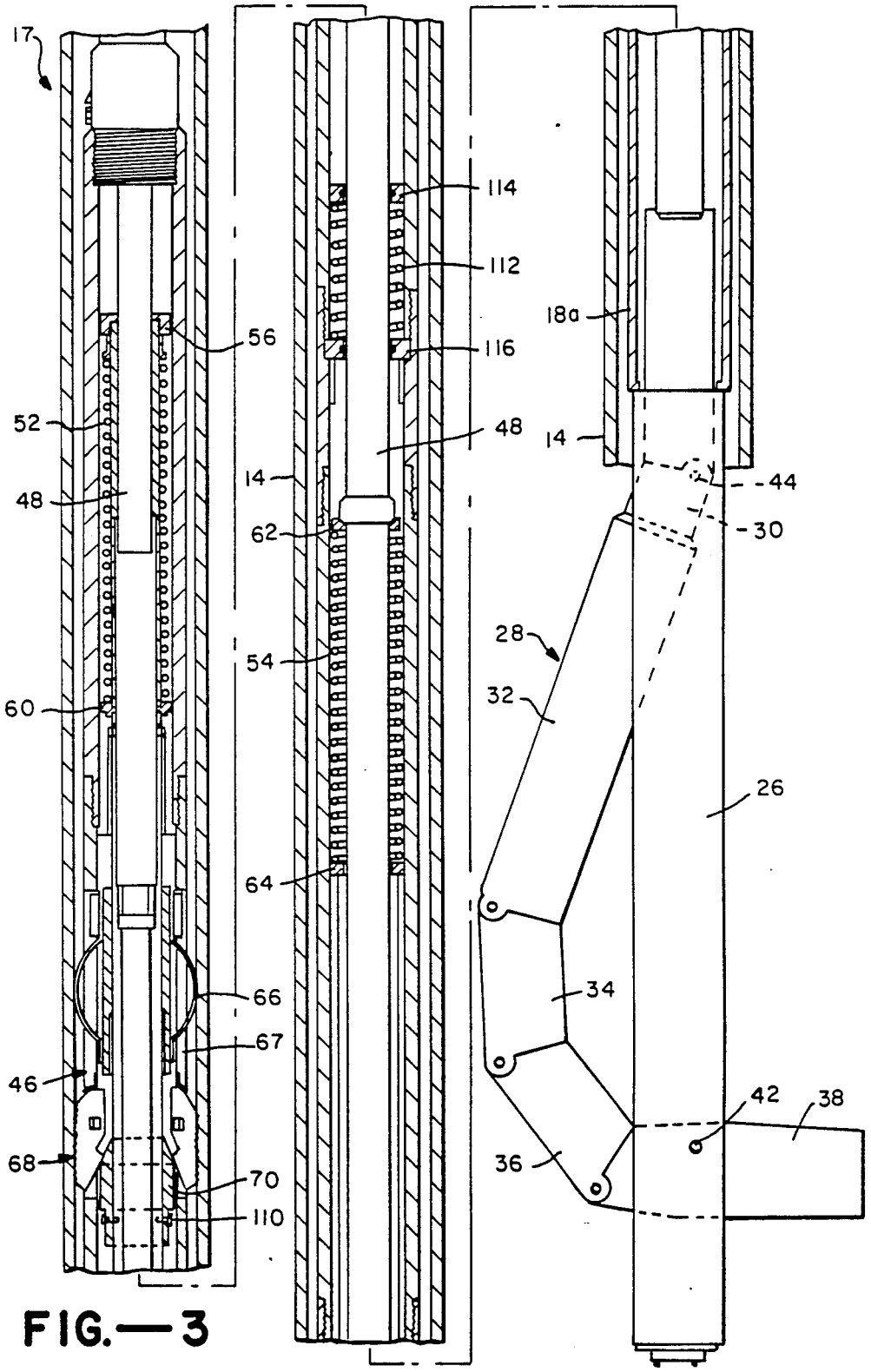
FIG. 3 is a detailed view in side elevation illustrating the whipstock assembly in its extended position.

As shown in FIGS. 2, 3 and 4, housing 26 carries five bending assemblies 30, 32, 34, 36 and 38 pivotally connected at hinges. Housing 26 contains the whipstock means in a deerected position, anchor means and means for erecting and deerecting the whipstock means as described hereinafter. Outer piping 18 includes clearance for the whipstock means to be erected. As illustrated in FIGS. 1, 3 and 4 clearance is to the left and right of the whipstock. By using whipstock sections 30, 32, 34, 36 and 38 of rectangular shape, housing 26 is in the form of flat rigid side plates 40 interconnected at the bottom by lift pin 42 and at the top by bolts 44 mounted to the interior piping and assemblies as described below. Lift pin 42 is pivotally connected to the most forward whipstock segment 38.

Referring specifically to FIGS. 1 and 2, housing 26 is lowered into casing 14 until it reaches the desired position adjacent to formation 12. All components of this system are contained within the structure during such passage in a manner that permits the system to be lowered through a preexisting casing.

Referring again to FIG. 2, anchor means 46 is illustrated in a retracted position within the casing with the whipstock means deerected. Anchor means 46 is operatively connected to the rearward side of whipstock means 28. In the illustrated retracted position, it slides within the earth well. In the anchored position illustrated in FIG. 3, it locks in a fixed position relative to the earth well and causes the whipstock means 28 to raise from the fixed anchor position and thus, lift pin 42 can be raised during erection as described below.

One significant feature of the system is that there is relative movement between casing 10 and inner piping 48 which is used to actuate erection and deerection of the whipstock means 28. Thus, when a part is described as being mounted to the inner piping, it moves when that part moves. The only part in the system which is not fixidly mounted is the anchor means which functions as set out below.

Inner piping 48 is mounted in outer piping 18 and, in combination with other portions of structure 17 serves to anchor, erect and deerect whipstock means 28. Inner piping 48 is threadedly connected at its forward end or lowermost segment the top segment 30 of whipstock means 28.

The system also includes deerection means comprising an upper deerection spring 52 and a lower deerection spring 54. Upper deerection spring retainer 56 is mounted to inner piping 48 and includes a lower shoulder 56*a* for retaining spring 52. An erection sliding seal 58 is mounted to the interior of inner piping 48 to maintain a seal with the drilling tube when the system is erected as described below. A lower spring retaining ring 60 is mounted to outer piping 18. Similarly, an upper spring retaining ring 62 is mounted to inner piping 48 while a lower spring retaining ring 64 is mounted to outer piping 18. Springs 52 and 54 provide the same kind of compressive forces for erection and deerection of the system as described below. They function in a similar manner and are additive in their compressive forces. If desired, a single spring could be utilized with the desired amount of force.

Anchor means 46 is the only portion of the illustrated apparatus that is not fixidly secured to either outer piping 18 or inner piping 48. Components of anchor means 46 are drag springs 66 slidably carried by inner piping 48 and projects through slot 67 in outer piping 18 to ride against casing 14 while the assembly is being lowered into position. Drag springs 66 serve to center the overall unit and to provide sufficient frictional force against casing 14 to permit the anchor to lock into position against it when outer piping 18 is pulled upwardly as described below.

Anchor means 46 also includes anchor jaws 68 with a saw tooth-like outer surface 68*a* for embedding into casing 14 when urged outwardly as set out below. The interior surface of anchor jaws 68 are sloping walls 68*b* which slope inwardly in an upward direction to provide a surface against which a correspondingly sloped ramp may act. Jaws 68 are slidably mounted to ride on inner piping 48 and are spring mounted so that they are urged inwardly unless actuated. When the system is lowered to the desired elevation adjacent the formation in the position illustrated in FIG. 2, anchor jaws 68 are out of registry with vertical slot 67 and so are retained within outer piping 18 by abutting against the adjacent wall of that structure. Such anchor jaws are are the same elevation as the vertical slots so that when it is desired to anchor the system, outer piping 18 is rotated relative to inner piping 48 causing the anchor jaws to move into registry with such slots whereby they are urged outwardly against the casing.

A jaw extension ramp 70 is mounted to outer piping 18 including a sloped upper wall 70*a* of a shape which mates with the inner sloping wall 68*b* of anchor jaws 68 to cause the anchor jaws to be urged outwardly when ramp 70 is moved upwardly relative to the jaws.

The operation of anchor means 46 is as follows. When the desired elevation adjacent to the formation is reached, the outer piping 18 is rotated relative to inner piping 48 to permit anchor jaws 68 to move into registry through their corresponding slots. The slots extend a sufficient distance below jaws 68 to permit upward movement of outer piping 18 to erect the system as described below. Structure 17 is pulled by an extension arm 72 which may comprise a pipe which extends all the way to the surface. Extension arm 72 includes a passage through which the drilling tube projects as described below. When extension member 72 is pulled upwardly, both the outer piping 18 and inner piping 48 are correspondingly pulled because they are connected at lifting pin 42. With the jaws in the slot, drag spring 66 provides sufficient resistance against upward movement that anchor jaws 68 begin to be locked into an embedded position in the casing wall when urged against the wall by jaw extension ramp 70 as the inner piping is pulled upwardly. Outer piping 18 is not affected because of the slot clearance.

Once the system is anchored, whipstock means 28 begins to erect because lift pin 42 is being moved upwardly while the top segment 30 of whipstock means 28 is being retained in a fixed elevational position by anchor means 46. Since guideway assembly 38 is pivotally mounted to lifting pin 42 and because lifting pin 42 is mounted eccentrically (towards the left hand side as illustrated) segment 38 begins to pivot to the left until the sloping upper wall 38*a* contacts the corresponding lower wall 36*a* of guideway assembly 36. Such pivoting begins at the bottom rather than the top because the lower piping segment 18*a* forms a shroud which maintains upper guideway assembly 30 in a fixed position during the initial erection. This permits the system to be erected into the desired configuration. Thereafter, after erection is begun, piping segment 18*a* clears upper guideway assembly 30 to permit it to be erected as illustrated in FIG. 3.

Springs 52 and 54 are partially compressed prior to lowering of the system into the earth well. This serves to maintain whipstock means 28 in a straight lien deerected configuration within side plates 40 for passage through the earth well by keeping the whipstock in tension. During erection, by pulling of the outer causing upwardly, upward retaining rings 56 and 62, being mounted to inner piping 48 are in a fixed elevational position while lower retaining rings 60 and 64, being mounted to outer piping 18 move upwardly to cause springs 52 and 54 to be further compressed. This assists in deerecting the system as described below. Such additional compression also stiffens the system which applies a strain load on the whipstock means to strengthen the hinges in the erected position.

Whipstock means 28 may be maintained in an erected position by insertion of a slip collar at the surface. When deerection is to be accomplished, the slip collar (not shown) is removed to permit the outer structure to move downwardly.

Referring to FIG. 4, a detailed view of the erected whipstock is illustrated. At the top of the whipstock is a high pressure seal which provides piston-like forces to push the piping through the whipstock and into the formation in the manner described with respect to U.S. Pat. No. 4,527,639, incorporated herein by reference. Briefly summarized, high pressure fluid is directed against a fluid pressure bearing area to the rearward side of the drillhead which is of the hydraulic jet type, including one or more jet type openings. When the drilling tube is forced through the whipstock, bending forces are applied to cause the tube to conform generally to the curve of the whipstock so that the tube is caused to turn into the formation. The pressurized drilling fluid presses against the seal and the portion of the guide pipe upstream from the seal so that the force is directed against the rearward side of the drill head cause it to project in a forward direction.

Whipstock means 28 functions as follows: Above seal 22 is a guide ring 80 which guides drilling tube 20 through the seal 22 and allows water to enter a bypass system whereby water can be used to flush the small annulus between the interior guide walls of the whipstock and the drilling tube. Prior to application of the hydraulic forces, the drilling tube is placed into the seal. Then, the system is pressurized so that drilling tube 20 moves past the first two wheels 82 in the system. Then, the drilling tube contacts the first ramp 84 in guideway assembly 30 which causes a bending action toward the backside of the whipstock means and loads the third wheel 86 is guideway assembly 30.

The drilling tube now enters guideway assembly 32 and is guided by the first two wheels 88 causing the drilling tube to be guided along the ramp of that section until it hits the last ramp 90 just above the last wheel 92 to force the drilling tube to load onto wheel 94 and start the bending motion of the drilling tube toward the right hand side of the drawing. Wheels 92 and 94 provide the initial bending of the drilling tube into about a one foot radius which allows it to move through guideway assemblies 34 and 36 without substantial additional bending moments.

Wheels 98 in guideway assembly 34 and wheels 100 in guideway assembly 36 act as guide wheels to position drilling tube 20 relative to guideway assembly 38 which serves as a straightener. The ramps in guideway assemblies 34 and 36 assist in loading the drilling tube 20 onto such wheels if the bending is not sufficiently precise. As drilling tube 20 exits guideway assembly 36, it is guided by the wheels in that segment to cause the drillhead to contact the ramp at the bottom of guideway assembly 38 which loads the drillhead onto straightener wheel 102 mounted in carriage 104 which forces the drillhead to the top of segment 38 and causes it to move into the formation in a straight line. Carriages 104 is adjustable so that by calibration, the position of wheel 102 may be set so that the drillhead proceeds horizontally into the formation or at any desired angle.

One advantage of whipstock means 28 is that it projects to both sides of the housing and so less underreaming is required than if it projected only to one side. As illustrated, the whipstock means assumes an inverted comma shape with the drillhead turning at a relatively sharp angle just prior to moving into the formation. Underreaming may be accomplished in a conventional manner.

Another advantage of the internal mechanism of the whipstock means is that due to the unique use of rollers and slides, the friction is low, the drillhead can make the initial turn without damage and the drilling tube is maintained in a relatively round configuration during the turning. The use of the wheels and ramps permits this to be accomplished with minimum flattening of the system.

A significant advantage of the present system is that the whipstock means is erected by the simple mechanical force of pulling from the surface rather than by the use of a hydraulic cylinder to cause erection. One advantage of such erection is the precise knowledge that the whipstock means is fully erected to permit the radial to move horizontally into the formation. This is known because when the outer structure is pulled upwardly at the surface a predetermined distance for full erection, the whipstock is erected. This is to be contrasted with hydraulic cylinders which are not as precise in their operation due to leaks and the like. Also, since there is a continuous string to the surface, pipe stretch does not affect the function of erection.

The system of the present invention is also capable of ready deerection to either move structure 17 to another portion of the same earth well or to pull it totally out of the earth well for reuse in another earth well. In essence, deerection is accomplished by releasing the anchor means from the casing, causing the inner piping to move downwardly relative to the outer structure and thereby moving lifting pin downwardly to pull the segments of the whipstock into a straight line as illustrated in FIG. 2. Springs 52 and 54 are maintained under sufficient compression so that even during deerection, the segments of the whipstock means are maintained under tension to prevent spontaneous erection of the system.

During deerection, the outer structure is moved downwardly causing lift pin 42 to move correspondingly downwardly and to move the whipstock means into a straight line or retracted position. With the whipstock means in a straight line, continued lowering of the outer structure 26 causes inner piping 48 to be pulled downwardly at lift pin 42 and thereby causing ramp 70 to move downwardly out of engagement with the corresponding inner walls of 68*b* of jaws 68. In this manner, jaws 68 collapse against inner piping 48. Then, outer structure 26 is rotated relative to jaws 68 to cause the jaws to move out of registry with the corresponding slot and to be thereby retained in a retracted position by adjacent wall segments of the outer structure. With the jaws 68 prevented from locking against the inner wall of casing 14, the entire unit may be lifted up out of the earth well.

Should the above deerection system not work due to sand clogging of the jaw slots or the like, backup systems may be provided. In one backup system, jaw extension ramp 70 is mounted to inner piping 48 by shear pin 110. If the jaws will not release in a manner set out above, sufficient pushing force is applied from the surface against structure 17 to shear the shear pins and cause ramp 70 to fall out of engagement with jaws 68. For this purpose, support spring 112 is provided below the ramp 70 which is sealed by upper and lower wiper rings 114 and 116 respectively against sand from moving into the system. In this manner, when shear pins 110 are sheared, ramp 70 may fall a sufficient distance to release jaws 68 due to the clearance provided by srping 112.

As set forth above, during erection of the whipstock, outer piping moves upwardly relatively to fixed inner piping 48. Therefore, a potential gap may be created between the uppermost segment of piping 48 and the drilling tube moving through the piping. It is essential to maintain a hydraulic seal in order to utilize the piston-like forces described above to push the drilling tube through the inner piping and out the whipstock by hydraulic forces. Accordingly, sliding seal 58 is mounted to the outer piping 18 to provide a high pressure hydraulic seal to prevent any gap during relative movement of the outer piping and inner piping.

In operation of the present system, a radial is placed in the desired mineral bearing formation, typically in an oil field. The surrounding formation may be heated as by injection of steam and oil is caused to flow either back to the same well or towards another production well. In typical operation, prior to production in this manner, the drilling tube portion projecting into the formation is severed near the whipstock by conventional means. In order to deerect the system, the drilling tube is first removed from the whipstock section by pulling upwardly from the surface. This, of course, is facilitated by first severing the portion of the drilling pipe projecting into the formation. Thereafter, deerection is accomplished as set forth above.

The above system is particularly effective when used in conjunction with a drilling pipe propelled by hydraulic forces as set forth in above. For that purpose, hydraulic seals are provided in this system to accomplish the piston-like effect. However, it should be understood that the system may also be employed to move a radial pipe into the formation by some other means.

What is claimed is:

1. Earth well drilling apparatus comprising structure including whipstock means adapted to be positioned within an earth well adjacent to a mineral bearing formation, said whipstock means comprising a plurality of connected guideway links laterally extendible from a retracted position substantially within the well to an extended position forming a curved tube bending guideway, piping within the well to which said whipstock means is attached, anchor means operatively connected to the rearward side of said whipstock means and having a retracted position for sliding through said earth well and an anchoring position for locking in a fixed position relative to said earth well, and erection means slidable within said earth well, said erection means being pivotally connected at one end to a forward one of said guideway assemblies and at the other end to extension means extending to the earth surface, said pivotal connection being of a type to cause said guideway links to swing into said curved guideway to extend a substantial distance outside of said well into said formation when said extension means is pulled from the earth surface with said whipstock means fixed at its rearward end.

2. The apparatus of claim 1 in which said erection means includes a wall segment defining slot means, said anchor means including retractible jaw means capable of retention by said wall segment in a retracted position and of projecting through said slot means into contact with said earth well wall in said locking position.

3. The apparatus of claim 1 in which said erection means includes a shroud section extending forward partially over the rearmost guideway link prior to pulling rearwardly to prevent initial pivoting of that link but clearing said rearmost guideway link prior to full erection.

4. The apparatus of claim 1 together with deerection means serving to urge said extended guide assemblies into their retracted position.

5. The apparatus of claim 4 in which said deerection means comprises compression spring means for maintaining sufficient pressure between said extension member and said guide assemblies at said pivotal connection to keep said guide assemblies in tension, whereby release of the pulling force on said erection means urges said whipstock means to move to its retracted position.

6. A method for placing a radial tube laterally into a mineral bearing formation for drilling from an earth well which extends downwardly from the surface of the formation to the region of radial tube placement, said method making use of a structure comprising whipstock means including a plurality of connected guide links laterally extendible from a retracted position substantially within the earth well to an extended position forming a curved tube bending guideway for a drilling tube to be extended radially into the formation, anchor means operatively connected to the rearward side of said whipstock means and having a retracted position sliding within said earth well and an anchoring position for locking in a fixed position relative to said earth well, and erection means slidable within said earth well, said erection means being pivotally connected to a forward one of said guide links and at the other end to extension means extending to the earth surface, said method comprising moving said whipstock means adjacent to the mineral bearing formation with said whipstock means and anchor means in a retracted position, moving said anchor means into said anchoring position, pulling from the earth surface on said extension means of said erection means to cause said forward one of said guide links to pivot away from said well to a sufficient extent to form said curved tube bending guideway, and moving a drilling tube through said guideway to cause it to bend and pass into said formation forming a radial tube.

7. The method of claim 6 in which said curved tube bending guideway is in a generally inverted comma shape with one portion projecting into the formation to one side of said pivotal connection and the other portion projecting into the formation to the other side of said pivotal connection.

8. The method of claim 6 further comprising the steps of collapsing said extended whipstock means into its retracted position, and retracting said anchor means and moving said whipstock structure.

9. The method of claim 8 in which said drilling tube is severed downstream of said whipstock and said drilling tube upstream of said whipstock means is pulled upwardly out of said whipstock means prior to collapsing said whipstock means into its retracted position.

10. Earth well drilling apparatus comprising structure including whipstock means adapted to be positioned within an earth well adjacent to a mineral bearing formation, said whipstock means comprising a plurality of connected guideway links laterally extendible from a retracted position substantially within the outer well to an extended position forming a curved tube bending guideway, piping within the well to which said whipstock means is attached, anchor means operatively connected to the rearward side of said whipstock means and having a retracted position for sliding through said earth well and an anchoring position for locking in a fixed position relative to said earth well, and erection means slidable within said earth well, said erection means being pivotally connected at one end to a forward one of said guideway links and at the other end to extension means extending to the earth surface, said pivotal connection being of a type to cause said guideway links to swing into said curved pathway when said extension means is pulled from the earth surface with said whipstock means fixed at its rearward end, said erection means further including a wall segment defining slot means, said anchor means including retractible jaw means capable of retention by said wall segment in a retracted position and of projecting through said slot means into contact with said earth well wall in said locking position.

11. The apparatus of claim 10 together with actuating means operatively connected to said whipstock means to actuate said jaw means into said locking position.

12. The apparatus of claim 11 in which said actuating means comprises ramp means forward of said jaw means and operatively associated with said erection means, said ramp means serving to urge said jaw means outwardly when said extension means is pulled from the earth surface.

13. The apparatus of claim 12 in which said anchor means includes drag spring means projecting through said slot means and contacting the wall of said earth well, said drag spring means serving to provide sufficient resistance against rearward movement caused by pulling from the earth surface to permit said ramp means to cause said jaws means to move outwardly.

14. Earth well drilling apparatus comprising structure including whipstock means adapted to be positioned within an earth well adjacent to a mineral bearing formation, said whipstock means comprising a plurality of connected guideway links laterally extendible from a retracted position substantially within the outer well to an extended position forming a curved tube bending guideway, piping within the well to which said whipstock means is attached, anchor means operatively connected to the rearward side of said whipstock means and having a retracted position for sliding through said earth well and an anchoring position for locking in a fixed position well and an anchoring position for locking in a fixed position relative to said earth well, and erection means slidable within said earth well, said erection means being pivotally connected at one end to a forward one of said guideway links and at the other end to extension means extending to the earth surface, said pivotal connection being of a type to cause said guideway links to swing into said curved pathway when said extension means is pulled from the earth surface with said whipstock means fixed at its rearward end, said curved tube bending guideway being in a generally inverted comma shape with one portion projecting into the formation to one side of said pivotal connection and the other portion projecting into the formation to the other side of said pivotal connection.

* * * * *